US006086644A

United States Patent [19]

Nakatsu et al.

[11] Patent Number: 6,086,644

[45] Date of Patent: Jul. 11, 2000

[54] SCENTED CANDLE AND MANUFACTURING METHOD FOR SAME

[75] Inventors: Tetsuo Nakatsu, Chappaqua; Carter B. Green, Stony Point, both of N.Y.; Andrew T. Lupo, Jr., Emerson, N.J.

[73] Assignees: Takasago International Corporation, Japan; Takasago Institute for Interdisciplinary Science, Inc., N.J.

[21] Appl. No.: 09/168,415

[22] Filed: Oct. 8, 1998

Related U.S. Application Data

[60] Provisional application No. 60/062,032, Oct. 10, 1997.

[51] Int. Cl.[7] ..... C10L 5/00

[52] U.S. Cl. ..... 44/275; 431/288

[58] Field of Search ..... 44/275; 431/288

[56] References Cited

U.S. PATENT DOCUMENTS 3,844,706 10/1974 Tsaras ..... 431/288

*Primary Examiner*—Gabrielle Brouillette
*Assistant Examiner*—Cephia D. Toomer
*Attorney, Agent, or Firm*—Morrison Law Firm

[57] ABSTRACT

A scented candle includes a candle manufacturing material, a fragrance provider, and at least one of polypropylene glycol and polypropylene glycol monoalkyl ether with a general formula (I)

$$H—(OC_3H_6)_n—O—R \quad (I)$$

where n is an integer between 2 and 40 and R is H or an alkyl group with a carbon number between 1 and 10.

13 Claims, No Drawings

SCENTED CANDLE AND MANUFACTURING METHOD FOR SAME

This application claims benefit to U.S. Provisional 60/062032 filed Oct. 10, 1997.

BACKGROUND OF THE INVENTION

The present invention relates to a candle which releases a constant fragrance over a long period of time. The present invention also relates to a manufacturing method for the same.

Various additives are used in candles to provide desirable qualities, such as color, scent, texture, and stability. For example, U.S. Pat. No. 4,449,987 (the entirety of which is herein incorporated by reference) describes candles containing the insect repellent methyl heptenone, coumarin, and indole to add both fragrance and insect repellence. U.S. Pat. No. 4,005,978 (the entirety of which is herein incorporated by reference) describes a means to reduce distortion at the time of molding by adding 0.5–1.5% by weight of anhydrous phthalic acid to the candle manufacturing material.

A candle, which is molded using a candle manufacturing material mixed with a dried pulverized mixture of starch breakdown products containing cyclodextrin or cyclodextran and a perfume, is stabilized in terms of heat by clathrating the perfume. It is disclosed that the dispersion quality, compatibility, and storage quality of the fragrance are dramatically improved at the time of mixing into the candle (refer to Japanese laid-open patent publication number 56-11995). Candles made from flammable materials and flammable wicks, and candles which give soft lighting and which consist mainly of higher fatty acids, metal salts of resin acids, sugars or alcohols, where colorants and perfumes are added as necessary are known. Polyoxypropylene-monoalkyl-ether with a high degree of polymerization (n=40–60) is disclosed as a preservative for a perfume composition (see Japanese Laid-open Publication Number 6-74435).

In candles of the prior art, there remain many combinations of fragrances and candle manufacturing materials that are unacceptable. In some combinations, chemical and physical interactions between the fragrance materials and candle manufacturing materials give rise to candles which show a variety of poor performance qualities. Examples of poor performance includes, but is not limited to, poor odor quality, poor odor intensity, poor odor diffusion, slow burn rate, excess soot generation and poor fragrance stability during storage.

OBJECTS AND SUMMARY OF THE INVENTION

The object of the present invention is to provide a candle and a method for manufacturing a candle which overcome the problems of the prior art.

A further object of the present invention is to provide a candle with excellent perfume dispersion and stability.

A further object of the present invention is to provide a method to manufacture candles with excellent perfume dispersion and stability.

According to the present invention, a scented candle includes a candle manufacturing material, a fragrance provider, and at least one of polypropylene glycol and polypropylene glycol monoalkyl ether with a general formula (I)

$$H—(OC_3H_6)_n—O—R \quad (I)$$

where n is an integer between 2 and 40 and R is a hydrogen or an alkyl group with a carbon number between 1 and 10.

The above, and other objects, features and advantages of the present invention will become apparent from the following description.

DETAILED DESCRIPTION OF THE PREFERRED EMBODIMENT

In order to overcome the problems of the conventional technology previously described above, a scented candle according to the present invention provides a candle manufacturing material which contains a fragrance provider and at least one of polypropylene glycol and polypropylene glycol monoalkyl ether, which is expressed by general formula (I):

$$H—(OC_3H_6)_n—O—R \quad (I)$$

where n is an integer from 2 to 40, and R indicates a hydrogen or an alkyl group having a carbon number from 1 to 10.

The present inventors have also discovered a manufacturing method for a scented candle wherein a fragrance provider and at least one of polypropylene glycol and polypropylene glycol monoalkyl ether with general formula (I) (as above) are added to and mixed with the pre-melted candle manufacturing material prior to pouring into molds for the formation of the finished candle.

The polypropylene glycol monoalkyl ether compound of the present invention is a type of polypropylene glycol derivative where there is a ring-opening polymerization of an aliphatic alcohol by a propylene oxide and an ether bond is formed. The average degree of polymerization is between about 2 and about 40 moles. Although polypropylene glycol monoalkyl ethers are conventionally available, the degree of polymerization required in production of candles is crucial.

The degree of polymerization is critical to obtain proper solubility in the production material of the candle at the time of heating, the proper hardness when molded, and the appropriate degree of flatness of the burn surface when the candle is burning. Furthermore, the degree of polymerization is important in helping the added perfume to dissolve and mix within the candle manufacturing material.

In the present invention, the degree of polymerization is such that n is from 2 to 40. If the degree of polymerization surpasses this, the viscosity becomes large, and material becomes difficult to handle. There is also a stickiness in the feel at the time of use. If the degree of polymerization is below this, there are problems in terms of the maintenance of the fragrance and the flammability. The R of the aliphatic alcohol is from 1 to 10.

When R is a butyl group, n is preferably between about 2 to 33 (Mn being from 200 to 2000). A more preferred range for n is from 4 and 16 (Mn being between about 300 and 1000).

When the carbon number of group R exceeds 10, the viscosity increases. Then, a hardness develops, the miscibility with the perfume material and the candle manufacturing material is decreased. This is not preferred.

A methyl group, ethyl group, propyl group, n-butyl group, n-pentyl group, n-hexyl group, n-heptyl group, n-octyl group, n-nonyl or n-decyl group can be used, and in particular the n-butyl group is preferred. The amount to be used is between about 0.1 to about 10% by weight of the candle manufacturing material, and preferably is between about 0.5 to about 8% by weight.

Furthermore, a variety of additives such as stearic acid, colorants and repellents can be added to the candle manufacturing material. Adding these additives still obtains a good quality candle.

There are no particular limitations for the perfume to be used in the present invention. However, because the main material of the candle of the prior art is paraffin, a perfume product with a strong polarity is difficult to use due to problems with solubility. If at least one of polypropylene glycol and polypropylene monoalkyl ether of the present invention is added to the paraffin material, a variety of perfume items can be used. The scent of the perfume can be chosen according to the location or atmosphere where it is to be used, and rose and citrus and the like are preferred.

There are no particular limitations to the candle manufacturing material. Materials which can be used include, but are not limited to, paraffin, bee's wax, synthetic wax, sugars, fatty acids such as stearic acid and the like, polyamide resins, aliphatic amides, aliphatic alcohols, divalent alcohols, polyvalent alcohols, emulsifiers, oils such as palm or soy bean oil or the like. Combinations of additional commonly used additives can also be used. The candle manufacturing material needs to have a melting point of 70 to 80° C.

The present invention is characterized by the discovery of a substance which can be added to the candle manufacturing material and which improves its function. The manufacturing means for the candle is achieved by conventional methods.

Embodiment 1 - Perfume model

Preparation of perfume model - Two types of perfume preparations were created using the following recipes.

| 1. Spice perfume | Weight % |
|---|---|
| aldehyde C-10 | 2.0 |
| cinnamic aldehyde | 5.0 |
| dianthine base | 52.7 |
| eugenol | 5.0 |
| isobornylacetate | 5.0 |
| linalyl acetate | 2.5 |
| menthol | 10.1 |
| sweet balsam base | 17.7 |
| Total | 100.0 |

| 2. Rose perfume | Weight % |
|---|---|
| green ozone type base | 4.5 |
| citrus base | 9.4 |
| phenethyl alcohol | 15.9 |
| rose base | 11.0 |
| white floral base | 4.6 |
| violet base | 1.5 |
| lilial | 18.7 |
| hedione | 9.4 |
| hexyl cinnamic aldehyde | 6.6 |
| kovanol | 11.4 |
| benzyl salicylic acid | 4.9 |
| musk base | 2.4 |
| Total | 100.0 |

Embodiment 1 - General candle preparation method

Approximately 500 g of paraffin wax (International Group Inc.), which is the candle manufacturing material, is placed in a glass beaker on top of a hot plate and is mixed with a stirrer and melted. Then, 93 g of hot wax, melted as described above, is poured into a flask. Next, 1 g of a polypropylene glycol monoalkyl ether and 6 g of perfume are added and stirred. This is heated and stirred for 5–10 minutes at 70 to 75° C. (at this time, the homogeneity of the mixture is assessed). Approximately 30 g of the wax mixture is poured into a 2 ounce jar which has been pre-heated to approximately 80° C. The wick is placed carefully in the center, and it is cooled overnight. The wick is trimmed to approximately a ¼ inch.

Comparative Example 1

A candle is prepared as described in Embodiment 1. However, no polypropylene glycol monobutyl ether (herein referred to as PPGMBE) is added. The perfume used is the spice formulation of Embodiment 1.

Embodiment 2

A candle is prepared as described in Embodiment 1. PPGMBE having a Mn of 1000 is used. The perfume used is the spice formulation of Embodiment 1.

Embodiment 3

A candle is prepared as described in Embodiment 1. PPGMBE having a Mn of 340 is used. The perfume used is the spice formulation of Embodiment 1.

Comparative Example 2

A candle is prepared as described in Embodiment 1. However, no PPGMBE is added. The perfume used is the rose formulation of Embodiment 1.

Embodiment 4

A candle is prepared as described in Embodiment 1. PPGMBE having a Mn of 1000 is used. The perfume used is the rose formulation of Embodiment 1.

Embodiment 5

A candle is prepared as described in Embodiment 1. PPGMBE having a Mn of 340 is used. The perfume used is the rose formulation of Embodiment 1.

TABLE 1

| Embodiment | Perfume | Content (weight %) | PPGMBE (weight %) | Mn |
|---|---|---|---|---|
| Comparative 1 | Spice | 6 | 0 | — |
| Embodiment 2 | Spice | 6 | 1 | 1,000 |
| Embodiment 3 | Spice | 6 | 1 | 340 |
| Comparative 2 | Rose | 6 | 0 | — |
| Embodiment 4 | Rose | 6 | 1 | 1,000 |
| Embodiment 5 | Rose | 6 | 1 | 340 |

Embodiments 6–10 - Candle Preparation Method 2

93.5 g, 92 g, 89 g, 84 g of paraffin wax is used. 0.5 g, 2 g, 5 g, 10 g, respectively, of PPGMBE of Mn 340 is added to each. 6g of "rose perfume" indicated in Embodiment 1 is added to each, and the candle is prepared according to the method in Embodiment 1.

Embodiment 6

Approximately 500 grams of paraffin wax as the candle manufacturing material is placed in a glass beaker on top of a hot plate. The wax is mixed with a stirrer and melted. From the melted wax, 93.5 grams is poured into a flask. Next, 0.5 grams of PPGMBE having a Mn of 340 and 6 grams of perfume are added and stirred. This mixture is heated and stirred for 5–10 minutes at 70 to 75° C. (at this time, the homogeneity of the mixture is assessed). Approximately 30 grams of the wax mixture is poured into a 2 ounce jar which has been pre-heated to approximately 80° C. The wick is placed carefully in the center. The candle thus formed is cooled overnight. The wick is trimmed to approximately a ¼ inch. The perfume used is the rose formulation of Embodiment 1.

Embodiment 7

A candle is prepared as described in Embodiment 6. From the melted wax, 92 grams is poured into a flask. Next, 2 grams of PPGMBE having a Mn of 340 and 6 grams of perfume are added and stirred. The perfume used is the rose formulation of Embodiment 1.

Embodiment 8

A candle is prepared as described in Embodiment 6. From the melted wax, 89 grams is poured into a flask. Next, 5 grams of PPGMBE having a Mn of 340 and 6 grams of perfume are added and stirred. The perfume used is the rose formulation of Embodiment 1.

Embodiment 9

A candle is prepared as described in Embodiment 6. From the melted wax, 84 grams is poured into a flask. Next, 10 grams of PPGMBE having a Mn of 340 and 6 grams of perfume are added and stirred. The perfume used is the rose formulation of Embodiment 1.

Embodiment 10

A candle is prepared as described in Embodiment 1. However, no PPGMBE is added. Instead 1 gram of polypropylene glycol (referred to as PPG) having a Mn of 725 and 6 grams of perfume are added and stirred. The perfume used is the rose formulation of Embodiment 1.

TABLE 2

| Embodiment | Perfume | Content (weight %) | Additive | Weight % | Average Molecular Weight (Mn) |
|---|---|---|---|---|---|
| Embodiment 6 | Rose | 6 | PPGMBE | 0.5 | 340 |
| Embodiment 7 | Rose | 6 | PPGMBE | 2.0 | 340 |
| Embodiment 8 | Rose | 6 | PPGMBE | 5.0 | 340 |
| Embodiment 9 | Rose | 6 | PPGMBE | 10.0 | 340 |
| Embodiment 10 | Rose | 6 | PPG | 1.0 | 725 |

Experiment 1 - Evaluation of the candles

After weighing the various candles constructed as above, the candles are burned for 2–3 hours in a room with a draft and evaluations were given.

The candle is placed vertically in a horizontally arranged 55 gallon steel can with a plexiglass window that can be opened for fragrance evaluations. Evaluations are conducted by 3 expert panelists. Evaluations had the following ratings, and an average is generated.

| Fragrance quality | Value |
|---|---|
| E = Excellent | 7 |
| VG = Very good | 6 |
| G = Good | 5 |
| F = Fair | 4 |
| M = Medium | 3 |
| P = Poor | 2 |
| NG = No good | 1 |

Fragrance Intensity: 0 (no smell) to 5 (extremely strong)

TABLE 3

| Embodiment | Fragrance Quality | Fragrance Intensity | Weight Loss grams/hour |
|---|---|---|---|
| Comparative 1 | 3.00 | 3.50 | 3.06 |
| Embodiment 2 | 4.83 | 3.75 | 2.94 |
| Embodiment 3 | 4.67 | 3.50 | 3.63 |
| Comparative 2 | 5.17 | 3.50 | 2.92 |
| Embodiment 4 | 4.67 | 4.67 | 2.90 |
| Embodiment 5 | 4.67 | 4.67 | 3.13 |

TABLE 4

| Embodiment | Fragrance | Content (weight %) | Additive | Weight % | Mn | Burning Speed (g/h) 1 | 2 | 3 | Average (g/h) |
|---|---|---|---|---|---|---|---|---|---|
| Comparative 2 | Rose | 6 | — | 0 | 340 | 3.93 | 4.17 | 4.32 | 4.14 |
| Embodiment 6 | Rose | 6 | PPGMBE | 0.5 | 340 | 3.50 | 4.15 | 4.66 | 4.10 |

TABLE 4-continued

| Embodiment | Fragrance | Content (weight %) | Additive | Weight % | Mn | Burning Speed (g/h) 1 | 2 | 3 | Average (g/h) |
|---|---|---|---|---|---|---|---|---|---|
| Embodiment 4 | Rose | 6 | PPGMBE | 1 | 340 | 4.09 | 4.09 | 4.16 | 4.11 |
| Embodiment 7 | Rose | 6 | PPGMBE | 2 | 340 | 3.67 | 3.96 | 4.26 | 3.96 |
| Embodiment 8 | Rose | 6 | PPGMBE | 5 | 340 | 3.71 | 4.05 | 4.53 | 4.10 |
| Embodiment 9 | Rose | 6 | PPGMBE | 10 | 340 | 4.12 | 4.19 | 4.38 | 4.23 |
| Embodiment 10 | Rose | 6 | PPG | 1 | 725 | 4.42 | 4.72 | 4.81 | 4.65 |

From the data in Tables 3 and 4, it is shown that the performance of a good performing candle (Comparative Example 2), made from an acceptable fragrance (rose) and candle manufacturing material (paraffin wax) combination, is not greatly affected by the addition of at least one of a polypropylene glycol or a polypropylene glycol monoalkyl ether having the general formula (1): $H—(OC_3H_6)_n—O—R$, where n is an integer between 2 and 40 and R is a hydrogen or an alkyl group with a carbon number between 1 and 10. On the other hand, the performance of a poor performing candle (Comparative Example 1), made from an unacceptable fragrance (spice) and candle manufacturing material (paraffin wax) combination, is significantly improved by the addition of a polypropylene glycol monoalkyl ether having the general formula (I) as indicated above.

These combinations of fragrance materials and candle manufacturing materials, which were shown in the prior art to be unacceptable for the production of candles, can now be used effectively in the preparation of finished candles by employment of the materials and methods of the present invention.

Having described preferred embodiments of the invention it is to be understood that the invention is not limited to those precise embodiments, and that various changes and modifications may be effected therein by one skilled in the art without departing from the scope or spirit of the invention as defined in the appended claims.

What is claimed is:

1. A scented candle, comprising:

a candle manufacturing material;

a fragrance provider; and a polypropylene glycol monoalkyl ether, having the following formula (I):

$$H—(OC_3H_6)_n—O—R \quad (I)$$

wherein n is an integer from 2 to 40, and R is an alkyl group having from 1 to 10 carbon atoms.

2. A scented candle according to claim 1, wherein said polypropylene glycol monoalkyl ether has an average degree of polymerization of between about 2 and about 40 moles.

3. A scented candle according to claim 1, wherein said polypropylene glycol monoalkyl ether has a Mn of between about 200 and about 2000.

4. A scented candle according to claim 1, wherein said polypropylene glycol monoalkyl ether has a Mn of between about 300 and about 1000.

5. A scented candle according to claim 1, wherein R is a butyl group and n is an integer between 2 and 33.

6. A scented candle according to claim 1, wherein R is a butyl group and n is an integer between 4 and 16.

7. A scented candle according to claim 1, wherein R is selected from the group consisting of a methyl group, an ethyl group, a propyl group, an n-butyl group, an n-pentyl group, an n-hexyl group, an n-heptyl group, an n-octyl group, an n-nonyl group, and an n-decyl group.

8. A scented candle according to claim 1, wherein R is an n-butyl group.

9. A scented candle according to claim 7, wherein said polypropylene glycol monoalkyl ether is present at an amount between about 0.1% to about 10% by weight of said candle manufacturing material.

10. A scented candle according to claim 7, wherein said polypropylene glycol monoaklyl ether is present at an amount between about 0.5% to about 8% by weight of said candle manufacturing material.

11. A scented candle according to claim 1, wherein said candle manufacturing material is selected from the group consisting of paraffin wax, beeswax, synthetic wax, a sugar, a fatty acid, a polyamide resin, an aliphatic amide, an aliphatic alcohol, a divalent alcohol, a polyvalent alcohol, an emulsifyer, an oil and an additive.

12. A scented candle comprising:

a candle manufacturing material;

said candle manufacturing material is paraffin wax;

a fragrance provider; and at least one of a polypropylene glycol and a polypropylene glycol monoalkyl ether, having the following formula (II):

$$H—(OC_3H_6)_n—O—R \quad (II)$$

wherein n is an integer from 2 to 40, and R is H or an alkyl group having from 1 to 10 carbon atoms.

13. A scented candle comprising:

a candle manufacturing material;

said candle manufacturing material has a melting point of 70 to 80° C.;

a fragrance provider; and at least one of a polypropylene glycol and a polypropylene glycol monoalkyl ether, having the following formula (II):

$$H—(OC_3H_6)_n—O—R \quad (II)$$

wherein n is an integer from 2 to 40, and R is H or an alkyl group having from 1 to 10 carbon atoms.

* * * * *